US007869724B2

(12) United States Patent
Yamasaki et al.

(10) Patent No.: US 7,869,724 B2
(45) Date of Patent: Jan. 11, 2011

(54) IMAGE DENSITY CONTROL DEVICE AND IMAGE FORMING APPARATUS

(75) Inventors: Naoya Yamasaki, Kanagawa (JP); Shunichiro Shishikura, Kanagawa (JP); Toru Yoshida, Tokyo (JP)

(73) Assignee: Fuji Xerox Co., Ltd., Tokyo (JP)

( * ) Notice: Subject to any disclaimer, the term of this patent is extended or adjusted under 35 U.S.C. 154(b) by 77 days.

(21) Appl. No.: 12/428,125

(22) Filed: Apr. 22, 2009

(65) Prior Publication Data

US 2010/0054774 A1 Mar. 4, 2010

(30) Foreign Application Priority Data

Aug. 26, 2008 (JP) ..... P2008-216533

(51) Int. Cl.
*G03G 15/00* (2006.01)

(52) U.S. Cl. ..... 399/49; 399/72

(58) Field of Classification Search ..... 399/38, 399/46–49, 72

See application file for complete search history.

(56) References Cited

U.S. PATENT DOCUMENTS 6,847,791 B2 * 1/2005 Kitagawa et al. ..... 399/49
7,260,335 B2 * 8/2007 Kato et al. ..... 399/49
7,272,333 B2 * 9/2007 Mizes ..... 399/49
7,509,063 B2 * 3/2009 Kimura et al. ..... 399/27

FOREIGN PATENT DOCUMENTS

JP 2000-258966 9/2000

* cited by examiner

*Primary Examiner*—Hoan Tran
(74) *Attorney, Agent, or Firm*—Morgan, Lewis & Bockius LLP

(57) ABSTRACT

An image density control device includes a first detecting unit that detects a light amount of first specular reflected light which is reflected from a surface of an image carrier, a second detecting unit that detects a light amount of first diffuse reflected light which is reflected from an image on the surface of the image carrier, a surface change information acquiring unit that acquires a surface change information which shows changes with time, and a control unit that corrects the light amount of the first specular reflected light by using the surface change information to a light amount of second specular reflected light, and controls the density of the image by using the light amount of the first diffuse reflected light and the light amount of the second specular reflected light.

10 Claims, 11 Drawing Sheets

IMAGE DENSITY CONTROL DEVICE AND IMAGE FORMING APPARATUS

This application is based on and claims priority under 35 USC 119 from Japanese Patent Application No. 2008-216533 filed Aug. 26, 2008.

BACKGROUND OF INVENTION

Field of the Invention

The present invention relates to an image density control device and an image forming apparatus.

SUMMARY OF INVENTION

According to an aspect of the invention, an image density control device includes a first detecting unit that detects a light amount of first specular reflected light which is reflected from a surface of an image carrier when light is irradiated onto a portion of no image on the surface of the image carrier, a second detecting unit that detects a light amount of first diffuse reflected light which is reflected from an image on the surface of the image carrier when light is irradiated onto the image on the surface of the image carrier, wherein the image is formed by an image forming unit, a surface change information acquiring unit that acquires a surface change information which shows changes with time in reflectance of the surface of the image carrier, and a control unit that corrects the light amount of the first specular reflected light by using the surface change information to a light amount of second specular reflected light, and controls the density of the image formed on the image carrier by using the light amount of the first diffuse reflected light and the light amount of the second specular reflected light.

BRIEF DESCRIPTION OF THE DRAWINGS

Exemplary embodiments of the invention will be described in detail based on the following figures, wherein.

DETAILED DESCRIPTION

Figure 1:
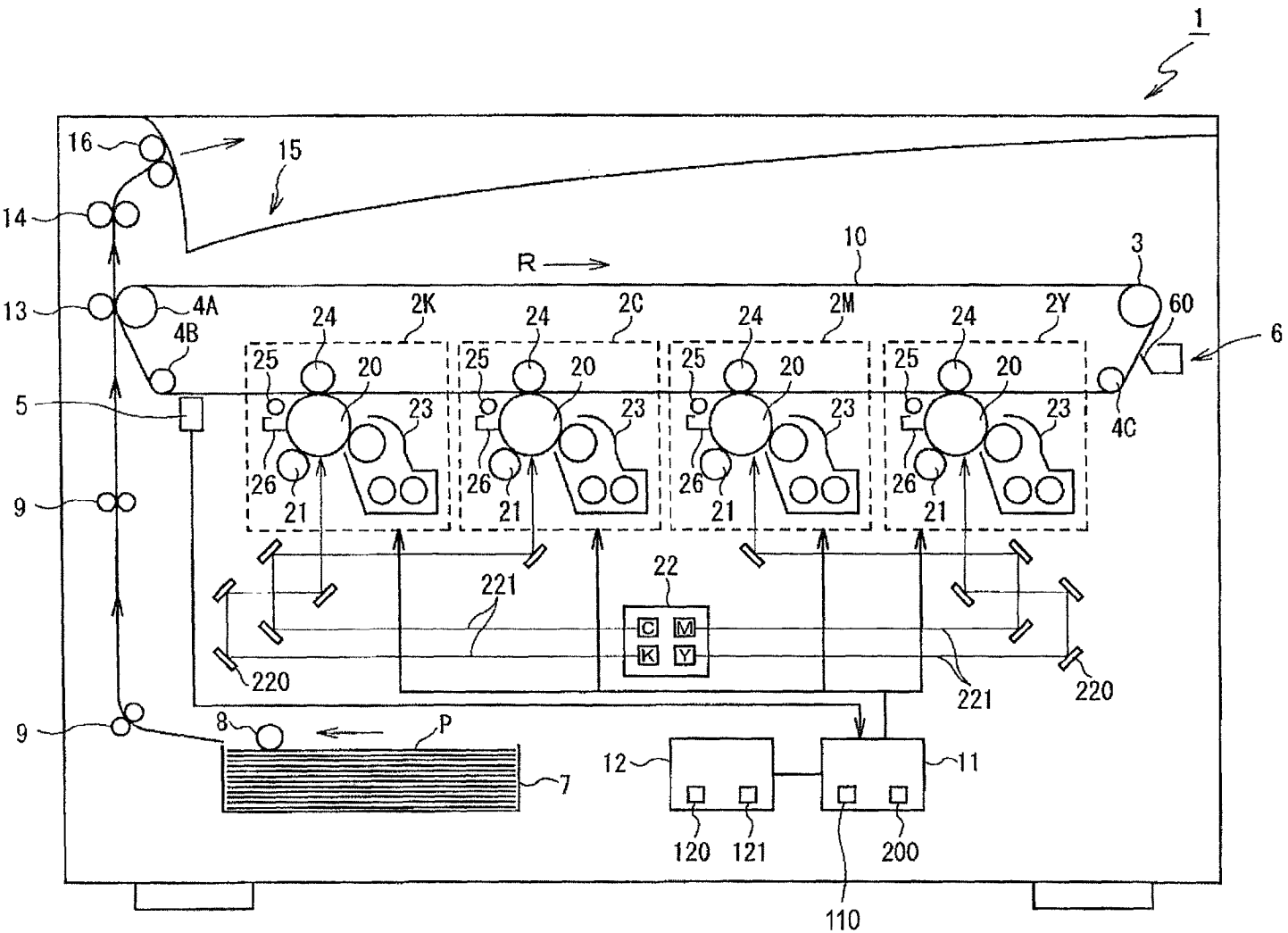
FIG. 1 is a view showing a schematic configuration example of the image forming apparatus of the first exemplary embodiment of the present invention.

An image density control device of an exemplary embodiment of the present invention includes: a first detecting unit which irradiates light onto the surface of an image carrier carrying no image, and detects a light amount of first specular reflected light reflected therefrom; a second detecting unit which irradiates light onto an image formed on the image carrier by an image forming unit and detects a light amount of first diffuse reflected light reflected therefrom; a surface change information acquiring unit which acquires surface change information showing changes with time in reflectance of the surface of the image carrier; and a control unit which corrects a light amount of the first specular reflected light by using the surface change information, and controls the density of an image to be formed on the image carrier by the image forming unit by using the corrected second specular reflected light amount and the light amount of the first diffuse reflected light.

When the second detecting unit irradiates light onto the surface of the image carrier carrying no image, and detects a light amount of second diffuse reflected light reflected therefrom, the surface change information acquiring unit may acquire the surface change information according to the light amount of the second diffuse reflected light. Further, the surface change information acquiring unit may acquire the surface change information according to image carrier operation history information concerning operations of the image carrier, cleaning history information concerning cleaning applied to the image carrier, colorant use history information concerning a colorant used when forming the image on the image carrier by the image forming unit.

The image density control device further includes a sensitivity change information acquiring unit which acquires sensitivity change information showing changes with time in detection sensitivity when detecting the light amount of the first specular reflected light and the light amount of the first diffuse reflected light by the first and second detecting unit, and the control unit may correct the light amount of the first specular reflected light, the light amount of the first diffuse reflected light, or a density target value of the image according to the sensitivity change information acquired by the sensitivity change information acquiring unit.

The sensitivity change information acquiring unit may acquire the sensitivity change information according to contamination information concerning contamination on the first and second detecting unit, opening and closing operation history information concerning opening and closing operations by the opening and closing operation mechanism of the first and second detecting unit, cleaning history information concerning the cleaning mechanism of the first and second detecting unit.

The image carrier is, for example, a photosensitive body, a transfer intermediate body, a sheet, or the like, and it is not limited to these as long as it carries images.

In the above-described configuration, the control unit of the image density control device corrects the light amount of the first specular reflected light so as to eliminate the influence of changes with time of the surface of the image carrier, and controls the image density by using the corrected second specular reflected light amount and the light amount of the first diffuse reflected light. Accordingly, even when the reflectance of the surface of the image carrier changes, this reflectance change is reflected in the control of the image density, so that higher-quality images are formed by the image forming unit in comparison with the case where the correction according to the surface change information is not performed.

First Exemplary Embodiment

FIG. 1 is a view showing a schematic configuration example of an image forming apparatus of a first exemplary embodiment of the present invention. This image forming apparatus 1 is a tandem type image forming apparatus including a transfer intermediate belt (image carrier) which carries toner images in black (K), yellow (Y), magenta (M), and cyan (C) formed by the respective first to fourth image forming units (image forming unit) 2K, 2Y, 2M, and 2C.

In other words, the image forming apparatus 1 includes a first image forming unit 2K which transfers a toner image in black, a second image forming unit 2Y which transfers a toner image in yellow, a third image forming unit 2M which transfers a toner image in magenta, a fourth image forming unit 2C which transfers a toner image in cyan, a drive roll 3 which is driven to rotate the transfer intermediate belt 10 in the arrow R direction, support rolls 4A to 4C which support the transfer intermediate belt 10 rotatably by a predetermined tensile force, a density detector (detecting unit) 5 which detects the densities of toner images transferred onto the transfer intermediate belt 10, a cleaning part 6 which cleans the surface of the transfer intermediate belt 10, a sheet supply cassette 7 which contains sheets P, a sheet feed roll 8 which delivers the sheet P from the sheet supply cassette 7, transport rollers 9 which convey the sheet P along a predetermined path, a secondary transfer roll 13 which is provided at a position opposed to the support roll 4A across the transfer intermediate belt 10 and secondarily transfers the toner images transferred on the transfer intermediate belt 10 onto the sheet P, a fixing part 14 which fixes the toner images transferred onto the sheet P, a discharge tray 15 onto which the sheet P having toner images fixed thereon is discharged through discharge rollers 16, a controller 11 which controls the image forming units 2K, 2Y, 2M, and 2C according to output values output from the density detector 5, and a memory 12 storing various programs and data, etc., necessary for control.

(Image Forming Units)

Each of the image forming units 2K, 2Y, 2M, and 2C includes a photosensitive drum 20 having a photosensitive layer on its surface, a charger 21 which applies a predetermined charge to the photosensitive drum 20 before being exposed, an exposure part 22 which forms an electrostatic latent image by exposing a photosensitive drum 20 by a laser beam 221 modulated based on image data of each color (K, Y, M, C) via a mirror 220, a developing device 23 which develops the electrostatic latent image formed on the photosensitive drum 20 by using toner of each color, a transfer device 24 which is disposed at a primary transfer position of the toner image and transfers the toner image onto the transfer intermediate belt 10, a neutralizer 25 which neutralizes the photosensitive drum 20, and a drum cleaner 26 which removes remaining toner remaining on the photosensitive drum 20 after primary transfer.

(Density Detector)

The density detector 5 functions as a first detecting unit which irradiates light onto an object to be detected such as the surface of the transfer intermediate belt 10 and a toner pattern described later, and detects specular reflected light reflected from the object to be detected, and a second detecting unit which detects diffuse reflected light reflected from the object to be detected. The first and second detecting unit output output values as light amounts corresponding to the detected intensities of the specular reflected light and the diffuse reflected light. The output values may be voltage values or current values, or are not limited to these.

(Cleaning Part)

The cleaning part 6 includes a blade 60 or the like for removing remaining toner remaining on the surface of the transfer intermediate belt 10 after secondary transfer. The cleaning part 6 may include a brush instead of the blade 60, or uses both of the blade and the brush without limiting to these.

(Controller)

The controller 11 is realized by, for example, an arithmetic circuit such as a CPU. The controller 11 includes a surface change information acquiring unit 110A which acquires surface change information showing changes with time in reflectance of the surface of the transfer intermediate belt 10, and a control unit 200 which corrects the output value (light amount of the first specular reflected light) of specular reflected light on the surface of the transfer intermediate belt 10 detected by the density detector 5 by using the surface change information, and by using the corrected output value (second specular reflected light amount) and the output value (light amount of the first diffuse reflected light) corresponding to the diffuse reflected light of the toner pattern, controls the densities of images to be formed on the transfer intermediate belt 10 by the image forming units 2K, 2Y, 2M, and 2C. The details of the control unit 200 will be described later.

The density detector 5, the surface change information acquiring unit 111A, and the control unit 200 compose an image density control device.

(Memory)

The memory 12 is a storage realized by, for example, a ROM, a RAM, a hard disk, or the like. The memory 12 stores a reference table 120 which becomes a reference for control of the density of a color image, and pattern image data 121 when forming a toner pattern, etc.

(Configuration Example of Density Detector)

Figure 2B:
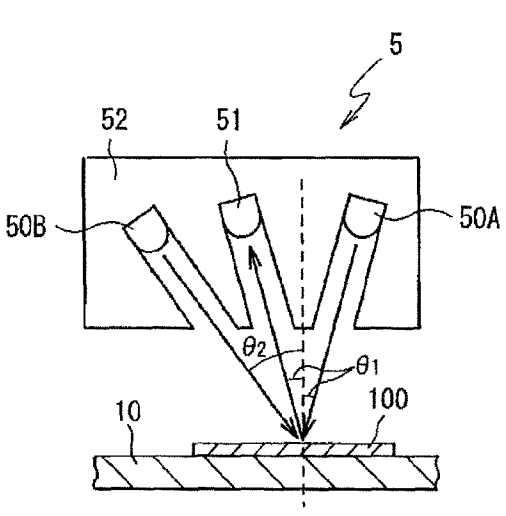
FIG. 2B is views showing a configuration example of the density detector.
Figure 2A:
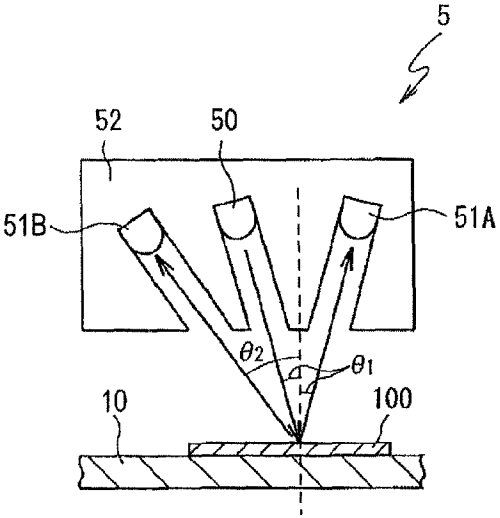
FIG. 2A is views showing a configuration example of the density detector.

FIG. 2A to FIG. 2D are views showing configuration examples of the density detector. FIG. 2A shows an example of a density detector consisting of one light emitting element and two light receiving elements. The density detector 5 illustrated in FIG. 2A includes a light emitting element 50 which irradiates light onto an object to be detected, a first light receiving element 51A which receives specular reflected light from the object to be detected, a second light receiving element 51B which receives diffuse reflected light from the object to be detected, and a housing 52 which houses the light emitting element 50 and the first and second light receiving elements 51A and 51B while blocking noise light from the outside.

The light emitting element 50 is disposed at a position at which irradiation light from the light emitting element 50 has an angle θ1 with respect to the perpendicular of the transfer intermediate belt 10, and consists of, for example, a light emitting diode (LED), etc.

The first light receiving element 51A is opposed to the light emitting element 50 and disposed at a position at an angle θ1 with respect to the perpendicular of the transfer intermediate belt 10. The second light receiving element 51B is disposed at a position at an angle θ2 with respect to the perpendicular of the transfer intermediate belt 10. The first and second light receiving elements 51A and 51B compose the first and second detecting unit, and are realized by, for example, photodiodes (PD), etc.

FIG. 2B is a view showing an example of a density detector consisting of two light emitting elements and one light receiving element. The density detector 5 illustrated in FIG. 2B includes a first light emitting element 50A which irradiates light to be specular reflected, a light emitting element 50B which irradiates light to be diffused and reflected, a light receiving element 51 which receives specular reflected light reflected by an object to be detected of light irradiated by the first light emitting element 50A and diffuse reflected light reflected by the object to be detected of light irradiated by the second light emitting element 50B, and a housing 52. The light receiving element 51 is commonly used as first and second detecting unit.

Figure 2D:
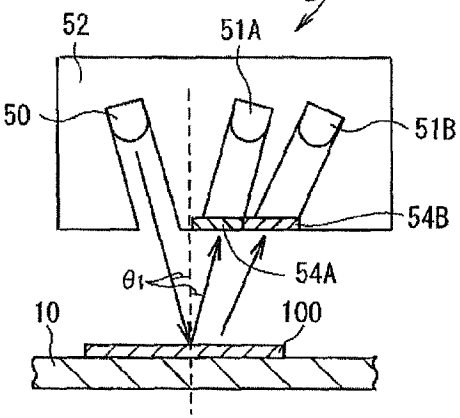
FIG. 2D is views showing a configuration example of the density detector.
Figure 2C:
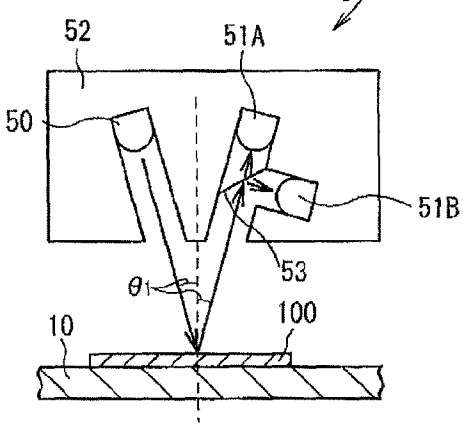
FIG. 2C is views showing a configuration example of the density detector.

FIG. 2C is a view showing an example of a density detector consisting of one light emitting element, two light receiving elements, and a polarizing element. The density detector 5 illustrated in FIG. 2C includes a light emitting element 50, a polarizing element 53 which polarizes reflected light reflected by an object to be detected of light irradiated by the light emitting element 50 into a specular reflected light component and a diffuse reflected light component, a first light receiving element 51A which receives the specular reflected light polarized by the polarizing element 53, and a second light receiving element 51B which receives diffuse reflected light polarized by the polarizing element 53, and a housing 52.

FIG. 2D is a view showing an example of a density detector consisting of one light emitting element, two light receiving elements, and a polarization filter. The density detector 5 illustrated in FIG. 2D includes a light emitting element 50, first and second polarization filters 54A and 54B which transmit light in a specific wavelength range corresponding to the specular reflected light and the diffuse reflected light, a first light receiving element 51A which receives specular reflected light transmitted through the first polarization filter 54A, a second light receiving element 51B which receives diffuse reflected light transmitted through the second polarization filter 54B, and a housing 52.

Hereinafter, description is given by assuming that the density detector 5 illustrated in FIG. 2A is used in the image forming apparatus 1.

(Toner Pattern)

Figure 3:
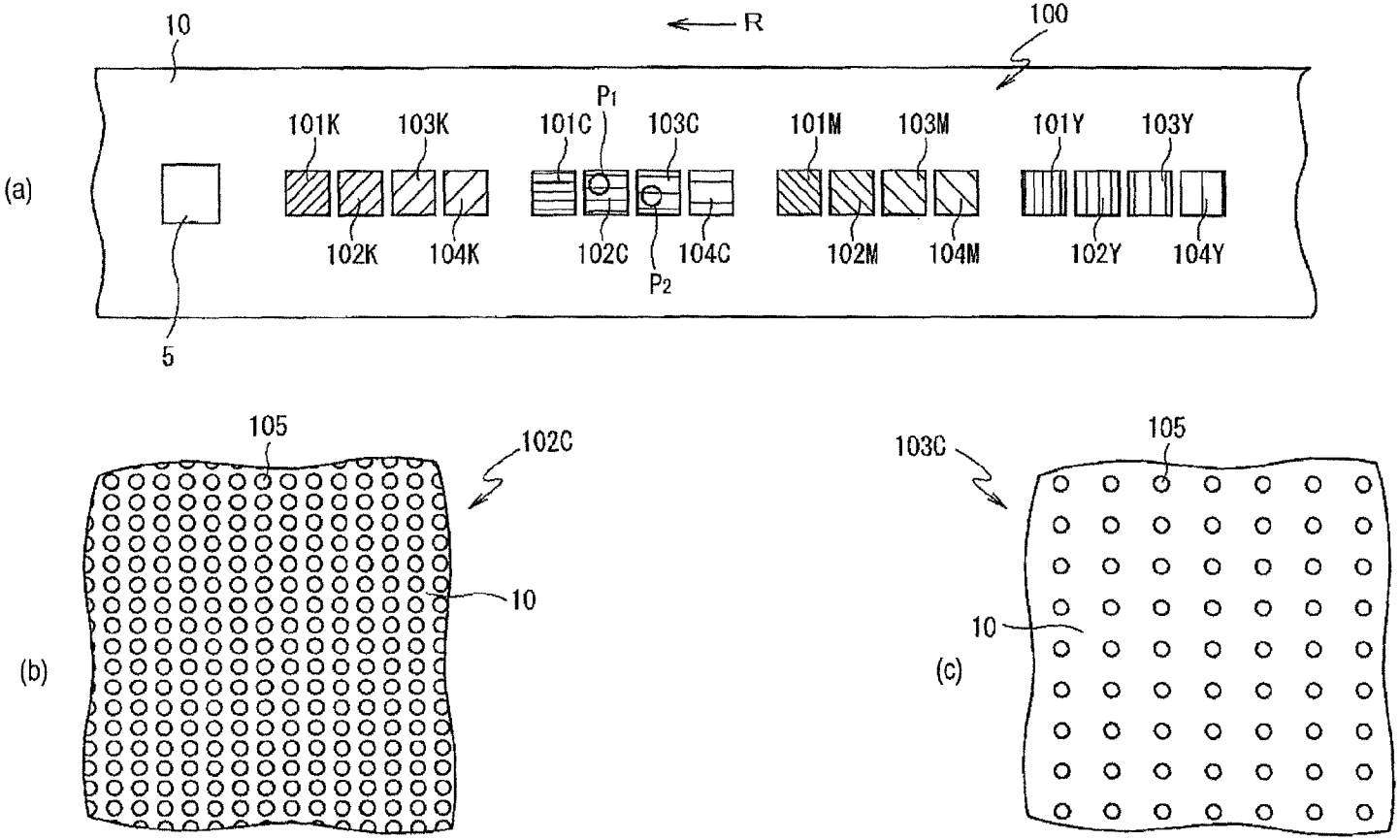
FIG. 3A is a view showing an example of a toner pattern formed on the transfer intermediate belt by the respective image forming units.
FIG. 3B is an enlarged view of portion P1 of the patch formed at a second toner density with cyan toner.
FIG. 3C is an enlarged view of portion P2 of the patch formed at a third toner density with cyan toner.

FIG. 3A is a view showing an example of a toner pattern 100 formed on the transfer intermediate belt 10 by the respective image forming units. The toner pattern 100 consists of patches 101Y, 101M, 101C, and 101K in the respective colors formed at a first toner density, and similarly, patches 102Y to 104Y, 102M to 104M, 102C to 104C, and 102K and 104K formed at second to fourth toner densities. The first to fourth toner densities are set by being changed so as to lower in order, and for example, when the toner density is reduced by 25%, the toner densities 100%, 75%, 50%, and 25% are set.

In the example of FIG. 3A, the toner pattern 100 is aligned in a row in parallel to the rotation direction R of the transfer intermediate belt 10, however, they can be aligned in plural of rows as long as they can be detected by the density detector 5, and the alignment is not limited to these.

FIG. 3B is an enlarged view of portion P1 of the patch 102C formed with cyan toner at the second toner density, and FIG. 3C is an enlarged view of portion P2 of the patch 103C formed with cyan toner at the third toner density. The patch 102C includes a larger number of toner particles 105 on the transfer intermediate belt 10 than that of the patch 103C.

(Detailed Configuration of Controller)

Figure 4:
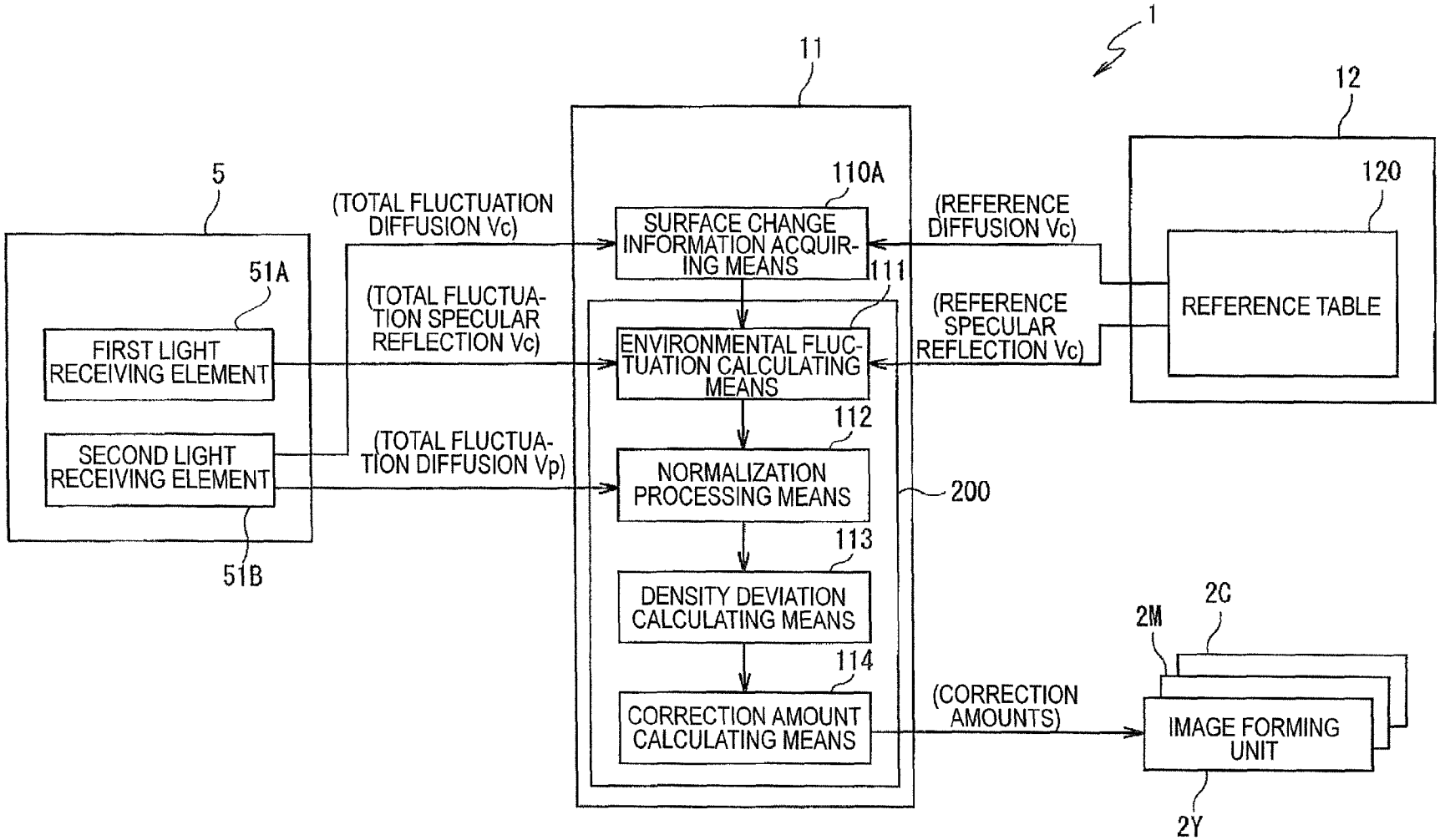
FIG. 4 is a block diagram showing an example of a control system of an image forming apparatus of a first exemplary embodiment of the present invention.

FIG. 4 is a block diagram showing an example of a control system of an image forming apparatus. The controller 11 includes a surface change information acquiring unit 110A, and an environmental fluctuation calculating unit 111, a normalization processing unit 112, a density deviation calculating unit 113, and an image forming condition correcting unit 114 composing a control unit 200.

(Surface Change Information Acquiring Unit)

The surface change information acquiring unit 110A acquires surface change information showing changes with time in reflectance of the surface of the transfer intermediate belt 10. Hereinafter, significance of acquisition of surface change information by the surface change information acquiring unit 110A will be described with reference to FIG. 5, and a surface change information acquiring method will be described with reference to FIG. 6.

Figure 5:
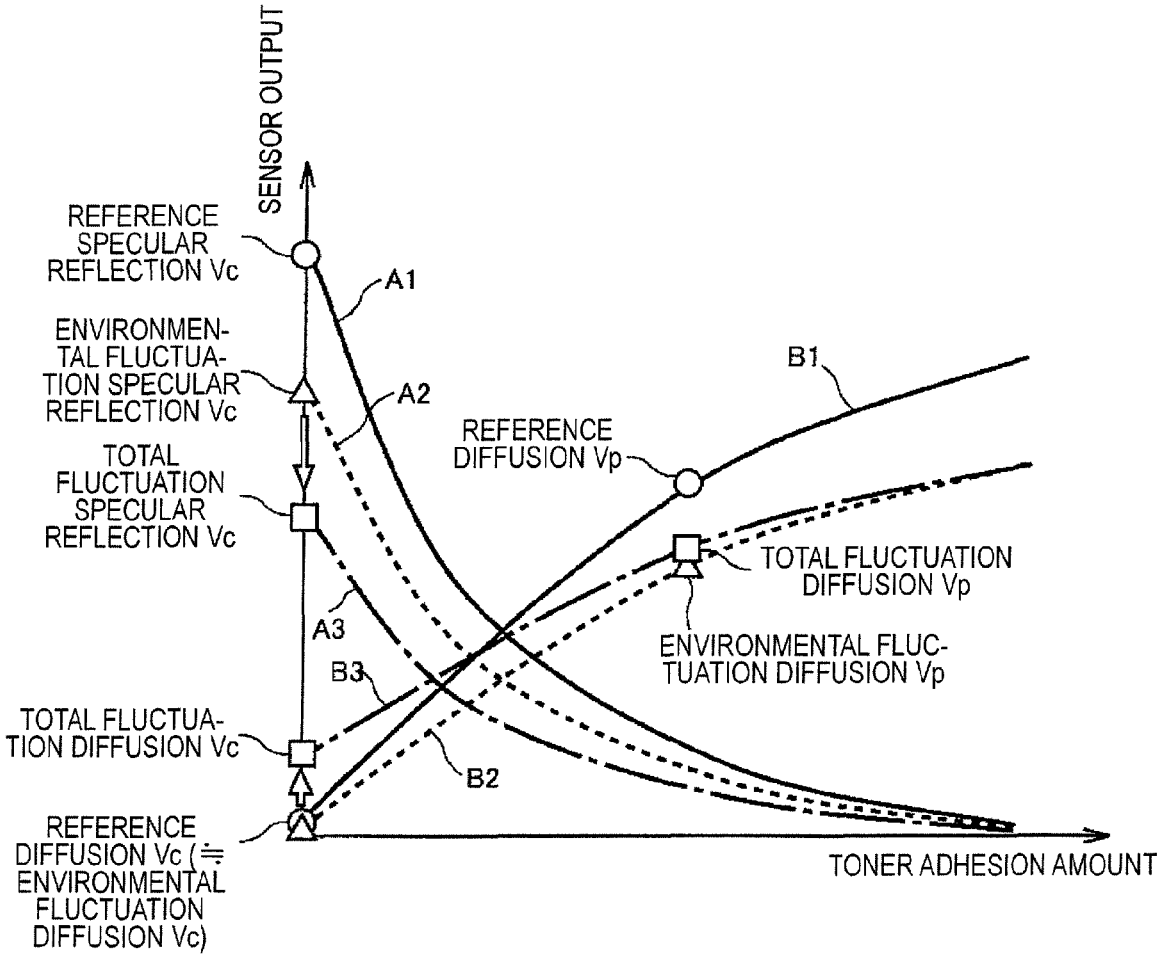
FIG. 5 is a diagram showing the relationship between the toner density (horizontal axis) of the toner pattern and output values (vertical axis) of the density detector.

FIG. 5 is a diagram showing the relationship between the toner density (horizontal axis) of the toner pattern and output values (vertical axis) from the density detector. The graphs A1 to A3 show output values of specular reflected light mainly from the surface of the transfer intermediate belt 10 received by the first light receiving element 51A, and the output value tends to become lower as the toner density increases. The graphs B1 to B3 show output values of diffuse reflected light mainly from the toner pattern 100 received by the second light receiving element 51, and the output value becomes higher as the toner density increases.

The graphs A1 and B1 indicated by the solid lines show output values as reference sensitivities of the first and second light receiving elements 51A and 51B. The graphs A2 and B2 indicated by dashed lines show output values of specular reflected light and diffuse reflected light when, for example, the environment such as the ambient temperature fluctuates with respect to the graphs A1 and B1 as the reference sensitivities. The graphs A3 and B3 show output values of specular reflected light and diffuse reflected light when the reflectance of the transfer intermediate belt 10 changes in addition to the above-described environmental fluctuation. Information corresponding to the graphs A1 and B1 are stored as a reference table 120 in the memory 12.

The surface change information acquiring unit 110A estimates the case where the output value of the first light receiving element changes due to not only the above-described environmental fluctuation but also a reflectance change, and corrects the output value. Factors which change the reflectance are cases where the surface of the transfer intermediate belt 10 is damaged by the blade 60 or remaining toner, etc., when being cleaned by the cleaning part 6, and is damaged by extraneous matter which adhered to the sheet P at the time of secondary transfer.

Here, when the toner density is "0," output values based on the reflected light from the surface of the transfer intermediate belt 10 are shown, and output values in the graphs A1 to A3 are defined as "reference specular reflection Vc," "environmental fluctuation specular reflection Vc," and "total fluctuation specular reflection Vc," and output values of diffuse reflected light from the transfer intermediate belt 10 in the graphs B1 to B3 are defined as "reference diffusion Vc," "environmental fluctuation diffusion Vc," and "total fluctuation diffusion Vc." Output values of diffuse reflected light from the toner pattern 100 with a specific toner density are defined as "reference diffusion Vp," "environmental fluctuation diffusion Vp," and "total fluctuation diffusion Vp."

Figure 6A:
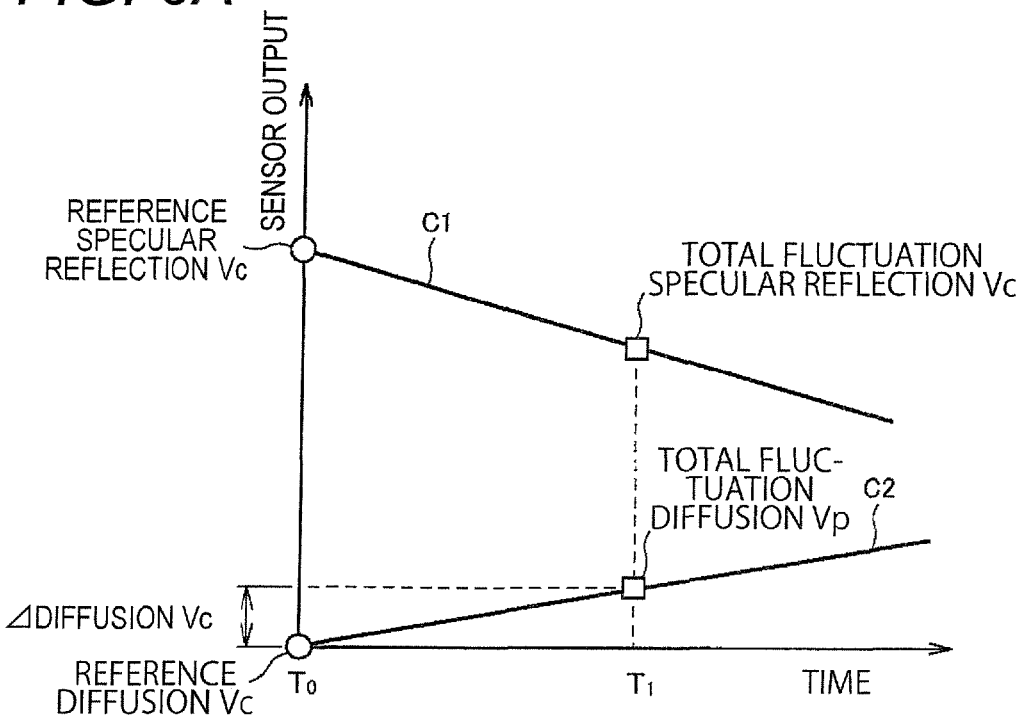
FIG. 6A is a diagram showing output values of specular reflected light and diffuse reflected light from the transfer intermediate belt when the reflectance of the transfer intermediate belt changes with time.

FIG. 6A shows, in the graphs C1 and C2, output values of specular reflected light and diffuse reflected light from the transfer intermediate belt 10 when the reflectance of the transfer intermediate belt 10 changes with time. At the time T0 meaning an initial state, the output values of specular reflected light and diffuse reflected light are the reference specular reflection Vc and the reference diffusion Vc. Thereafter, with elapse of the use time, when the reflectance of the transfer intermediate belt 10 gradually changes, the output value of specular reflected light tends to decrease, however, the output value of diffuse reflected light tends to increase.

Figure 6B:
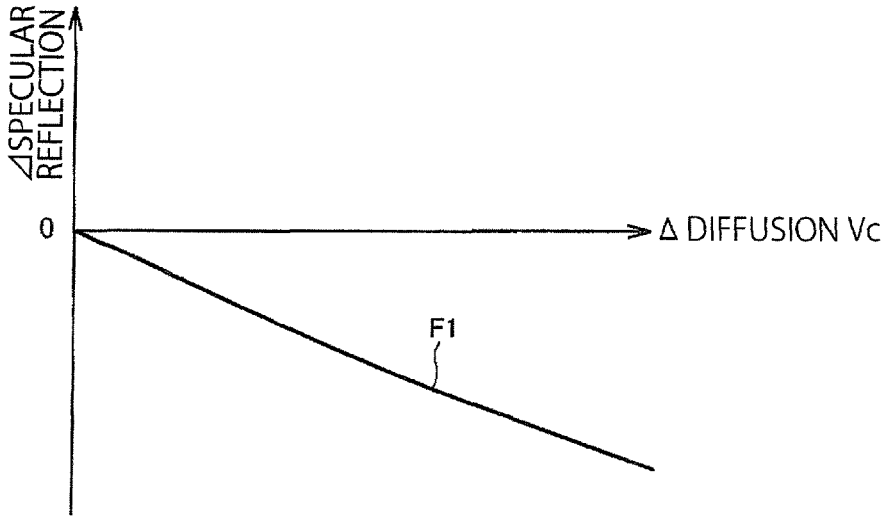
FIG. 6B is a diagram showing the relationship between an amount of change of specular reflected light "Δspecular reflection Vc" and an amount of change of diffuse reflected light "Δdiffusion Vc,"

FIG. 6B is a diagram showing the relationship between an amount of change of specular reflected light "Δspecular reflection Vc" (horizontal axis" and an amount of change of diffuse reflected light "Δdiffusion Vc" (vertical axis) when the reflectance of the transfer intermediate belt 10 changes. The relationship between Δspecular reflection Vc and Δdiffusion Vc is, for example, the relationship of monotonic decrease, and indicated as a function F1.

Therefore, the surface change information acquiring unit 110A acquires surface change information by calculating Δspecular reflection Vc according to the following formula (1) using Δdiffusion Vc by using the above-described relationship of monotonic decrease.

$$\Delta\text{specular reflection } Vc = F1(\Delta\text{diffusion } Vc) \qquad \text{Formula (1)}$$

Here, Δdiffusion Vc=total fluctuation diffusion Vc−reference diffusion Vc (≡environmental diffusion Vc)

In detail, the surface change information acquiring unit 110A receives the total fluctuation diffusion Vc output from the second light receiving element 51B by setting the surface of the transfer intermediate belt 10 as an object to be detected, and reads the reference diffusion Vc from the reference table 120. Next, the surface change information acquiring unit 110A calculates Δdiffusion Vc by subtracting the reference diffusion Vc from the total fluctuation diffusion Vc. Then, the surface change information acquiring unit 110A acquires Δspecular reflection Vc as surface change information by substituting Δdiffusion Vc into the formula (1).

The reason why the amount of change of the output value of specular reflected light (total fluctuation specular reflection Vc−reference specular reflection Vc) cannot be used as surface change information is that this amount of change includes both of the amount of change caused by an environmental fluctuation and the amount of change caused by a reflectance change, and it is impossible to acquire only the amount of change caused by the reflectance change by separating the amounts of change. On the other hand, the reference diffusion Vc and the environmental diffusion Vc are substantially equal to each other, so that Δdiffusion Vc corresponds to the amount of change caused by the reflectance change.

(Environmental Fluctuation Calculating Unit)

The environmental fluctuation calculating unit 111 calculates environmental fluctuation specular reflection Vc by correcting total fluctuation specular reflection Vc output from the first light receiving element 51A by using Δspecular reflection Vc acquired by the surface change information acquiring unit 110A. Here, to calculate the environmental fluctuation specular reflection Vc, the environmental fluctuation calculating unit 111 uses the following formula (2) established between the total fluctuation specular reflection Vc and the environmental fluctuation specular reflection Vc, reference specular reflection Vc, and reference specular reflection Vc read from the reference table 120.

$$\text{Total fluctuation specular reflection } Vc = (\text{reference specular reflection } Vc + \Delta\text{specular reflection } Vc) \times (\text{environmental fluctuation specular reflection } Vc / \text{reference specular reflection } Vc) + Vd \qquad \text{Formula (2)}$$

Here, Vd indicates a dark voltage.

In the above-described formula (2), the reason for the multiplication by "environmental fluctuation Vc/reference Vc" is that Δspecular reflection Vc is a value with respect to the reference sensitivity, and a sensitivity change caused by the environmental fluctuation is taken into consideration. Therefore, the environmental fluctuation calculating unit 111 calculates the environmental fluctuation specular reflection Vc according to the following formula (3) which is obtained by solving the above-described formula (2) with the environmental fluctuation specular reflection Vc.

$$\text{Environmental fluctuation specular reflection } Vc = (\text{total fluctuation specular reflection } Vc - Vd) \times \text{reference specular reflection } Vc / (\text{reference specular reflection } Vc + \Delta\text{specular reflection } Vc) \qquad \text{Formula (3)}$$

It can be said that the environmental fluctuation calculating unit 111 performs correction according to the surface change information by adding the reference specular reflection Vc to Δspecular reflection Vc according to the above-described formula (3), however, as illustrated in FIG. 6, Δspecular reflection Vc is a negative value, so that, for example, correction according to the surface change information can be performed by subtracting the absolute value of Δspecular reflection Vc from the reference specular reflection Vc. As the surface change information, when not the amount of change of the output value, but, for example, a rate of change is acquired, in the above-described formula (3), by multiplying or dividing the reference specular reflection Vc by using this rate, correction according to the surface change information may be performed. Without using the calculating formula, the environmental fluctuation calculating unit 111 may perform correction by using, for example, a correction table corresponding to surface change information.

(Normalization Processing Unit)

The normalization processing unit 112 performs normalization processing for calculating density characteristic value RADC_diffusion Vp according to the following formula (4) by using the total fluctuation diffusion Vp output from the first light receiving element 51A by setting the toner pattern 100 having a specific toner density specified by the surface change information acquiring unit as an object to be detected, and the environmental fluctuation specular reflection Vc calculated by the environmental fluctuation calculating unit 111.

$$RADC_\text{diffusion } Vp = (\text{total fluctuation diffusion } Vp - \text{total fluctuation diffusion } Vc \times (1 - Vp \text{ area ratio}) - Vd) / (\text{environmental fluctuation specular reflection } Vc - Vd) \qquad \text{Formula (4)}$$

Here, the Vp area ratio is an area ratio of the underlay of the toner pattern.

The Vp area ratio is a ratio obtained by dividing an area obtained by subtracting an area of the portion occupied by toner particles 105 of the toner pattern 100 from the area of the underlay of the transfer intermediate belt 10 which irradiation light from the light emitting element 50 strikes on the transfer intermediate belt 10 by the area of the underlay. In other words, the Vp area ratio is used for canceling the influence of diffuse reflected light from the transfer intermediate belt 10 on the total fluctuation diffusion Vp. The Vp area ratio becomes lower as the toner density becomes higher.

(Density Deviation Calculating Unit)

The density deviation calculating unit 113 calculates a density deviation ΔRADC according to the following formula (5) from the density characteristic value RADC_diffusion Vp calculated by the normalization processing unit 112 and a reference RADC as a control target value at the specific toner density calculated based on the reference table 120.

$$\Delta RADC = RADC_\text{diffusion } Vp - \text{reference } RADC \qquad \text{Formula (5)}$$

(Image Forming Condition Correcting Unit)

The image forming condition correcting unit 114 calculates correction amounts of image forming conditions for forming toner images based on the density deviation ΔRADC calculated by the density deviation calculating unit 113, and outputs the correction amounts to the image forming units 2K, 2Y, 2M, and 2C. The image forming conditions are, for example, a charging condition when charging the photosensitive drum 20 by the charger 21, an exposure condition when exposing the photosensitive drum 20 by the exposure part 22, and a developing condition when developing an electrostatic latent image on the photosensitive drum 20 by the toner image by the developing device 23, etc. The correction amounts may be corrected contents of image data before an image signal based on the image data is transmitted to the image forming units 2K, 2Y, 2M, and 2C.

(Variations of Calculating Formulas)

Hereinafter, variations of the calculating formulas to be used by the surface change information acquiring unit 101 and the control unit 200 will be described.

The surface change information acquiring unit normalizes the total fluctuation diffusion Vp by using the environmental fluctuation specular reflection Vc in the above-described formula (4), and for example, correction amounts of the image forming conditions may be calculated by obtaining the reference diffusion Vp at the reference sensitivity according to the following formula (6) using the total fluctuation diffusion Vp without normalization.

$$\text{Reference diffusion } Vp = \{(\text{total fluctuation diffusion } Vp - \text{total fluctuation diffusion } Vc \times (1 - Vp \text{ area ratio}) - Vd) \times (\text{reference } Vc - Vd)/(\text{environmental fluctuation } Vc - Vd)\} + Vd \qquad \text{Formula (6)}$$

When the dark voltage Vd is a very small value which can be ignored in comparison with other values, the term of dark voltage Vd can be omitted in the formulas (3), (4), and (6), and the changed formulas can be expressed as the following formulas (7) to (9).

$$\text{Environmental fluctuation specular reflection } Vc = (\text{total fluctuation specular reflection } Vc \times \text{reference specular reflection } Vc)/(\text{reference specular reflection } Vc - \Delta\text{specular reflection } Vc) \qquad \text{Formula (7)}$$

$$RADC_\text{diffusion } Vp = (\text{total fluctuation diffusion } Vp - \text{total fluctuation diffusion } Vc \times (1 - Vp \text{ area ratio}))/\text{environmental fluctuation specular reflection } Vc \qquad \text{Formula (8)}$$

$$\text{Reference diffusion } Vp = (\text{total fluctuation diffusion } Vp - \text{total fluctuation diffusion } Vc \times (1 - Vp \text{ area ratio})) \times \text{reference } Vc/\text{environmental fluctuation specular reflection } Vc \qquad \text{formula (9)}$$

(Operations of Image Forming Apparatus)

Figure 7:
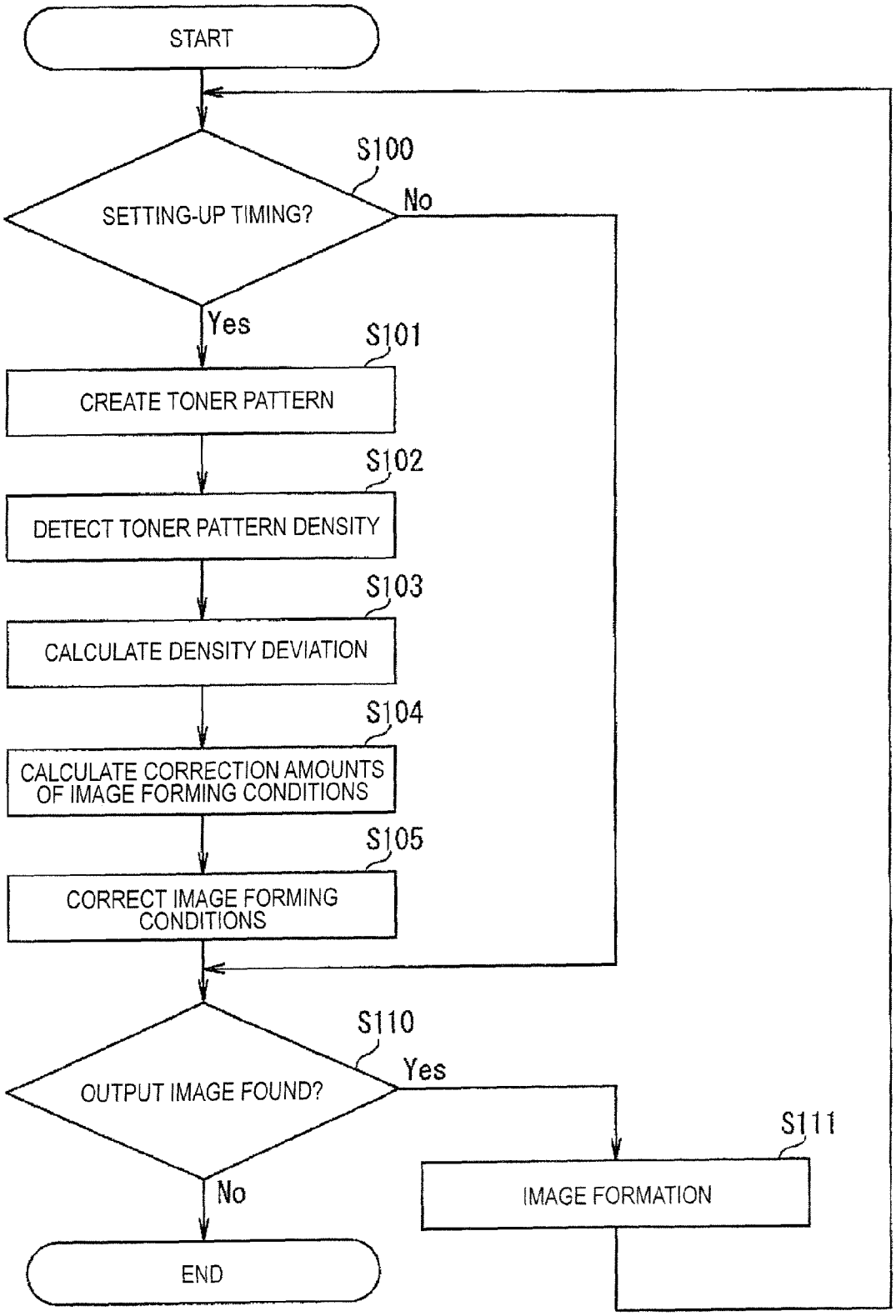
FIG. 7 is a flowchart showing an example of operations of the image forming apparatus.

Next, an example of operations of the image forming apparatus 1 will be described with reference to the flowchart of FIG. 7.

First, the controller 11 of the image forming apparatus 1 judges whether the current time is a timing of setting-up in each predetermined period (S100). The timing of setting-up is, for example, when the power supply is turned on, when a member such as a toner cartridge is replaced, when a predetermined number of sheets P are output, and when a predetermined time elapses.

Next, when the controller 11 judges that the current time is the timing of setting-up (S100: Yes), the controller reads pattern image data 121 from the memory 12, and transmits a pattern image signal based on the pattern image data 121 to the image forming units 2K, 2Y, 2M, and 2C. The image forming units 2K, 2Y, 2M, and 2C form the toner pattern 100 illustrated in FIG. 3 on the transfer intermediate belt 10 based on the pattern image signal (S101).

In detail, the photosensitive drums 20 of the image forming units 2K, 2Y, 2M, and 2C rotate, the photosensitive drums 20 are charged by the chargers 21 and then exposed by laser beams 221 corresponding to pattern images in the respective colors from the exposure part 22, and accordingly, electrostatic latent images are formed on the surfaces of the photosensitive drums 20. The electrostatic latent images on the photosensitive drums 20 are developed into toner images by the corresponding developing devices 23 of the respective colors. Then, the toner images are successively transferred onto the transfer intermediate belt 10 driven by the drive roll 3 by the transfer devices 24.

Then, the transfer intermediate belt 10 is driven to rotate by the drive roll 3, and when the transferred toner pattern 100 reaches the position at which the density detector 5 is disposed, the light emitting element 5 of the density detector 5 irradiates light onto the toner pattern 100, and specular reflected light and diffuse reflected light reflected from the toner pattern 10 are received by the first and second light receiving elements 51A and 51B. Then, an output value "total fluctuation diffusion Vp" corresponding to the intensity of the reflected light is output to the controller 11. The density detector 5 receives specular reflected light and diffuse reflected light from the surface of the transfer intermediate belt 10 onto which the toner pattern 100 is not transferred by the first and second light receiving elements 51A and 51B, and outputs output values "total fluctuation specular reflection Vc" and "total fluctuation diffusion Vc" corresponding to the intensities of these reflected lights to the controller 11 (S102).

Next, the controller 11 calculates a density deviation ΔRADC based on the output values output from the density detector 5 as described above and the reference table 120 recorded in the memory 12 (S103).

In other words, the surface change information acquiring unit 110A acquires Δspecular reflection Vc according to the above-described formula (1), and the environmental fluctuation calculating unit 111 calculates environmental fluctuation specular reflection Vc according to the above-described formula (3). Next, the normalization processing unit 112 performs normalization processing according to the above-described formula (4) and calculates density characteristic value RADC_diffusion Vp. Then, the density deviation calculating unit 113 calculates density deviation ΔRADC according to the above-described formula (5) from RADC_diffusion Vp calculated according to the above-described formula (4) and reference RADC based on the reference table 120.

Next, the image forming condition correcting unit 114 calculates correction amounts of image forming conditions based on the density deviation ΔRADC calculated by the density deviation calculating unit 113 (S104).

Next, when the correction amounts are transmitted from the controller 11 to the image forming units 2K, 2Y, 2M, and 2C, the image forming units 2K, 2Y, 2M, and 2C correct the image forming conditions based on the correction amounts (S105).

Then, when an output image is found (S110: Yes), the controller 11 transmits an output image signal based on the output image to the image forming units 2K, 2Y, 2M, and 2C. The image forming units 2K, 2Y, 2M, and 2C form image patterns based on the output image signal on the transfer intermediate belt 10 in the state where the image forming conditions are corrected at the Step S105. Then, when a sheet P is fed from the sheet supply cassette 7 via the sheet feed roll 8, the image patterns formed on the transfer intermediate belt 10 are transferred onto the sheet P by the secondary transfer roll 13, fixed by the fixing part 14, and discharged onto the discharge tray 15 via the discharge rollers 16 (S111). On the other hand, when an output image is not found (S110: No), the controller 11 ends the process without performing image formation.

Second Exemplary Embodiment

In the image forming apparatus 1 of the first exemplary embodiment, surface change information is acquired according to an amount of change of diffuse reflected light received by the second light receiving element 51B and corrects the image forming conditions. On the other hand, in the present exemplary embodiment, surface change information is acquired according to image carrier operation history information concerning the transfer intermediate belt 10, and image forming conditions are corrected.

Figure 8:
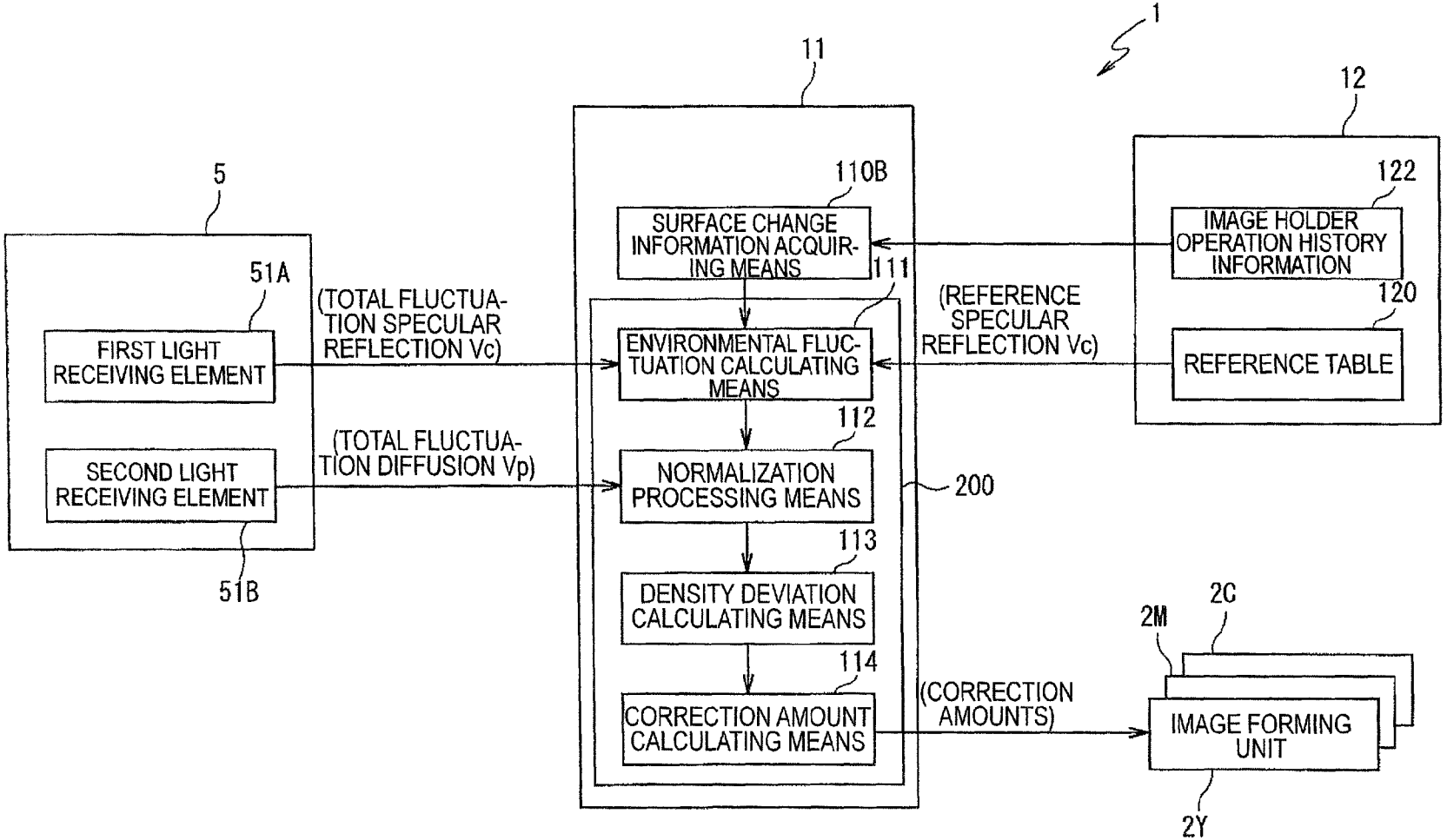
FIG. 8 is a block diagram showing an example of a control system of the image forming apparatus of the second exemplary embodiment of the present invention.

FIG. 8 is a block diagram showing an example of a control system of an image forming apparatus of the second exemplary embodiment. The memory 12 stores image carrier operation history information 122. The image carrier operation history information 122 is information for estimating changes in reflectance of the transfer intermediate belt 10 along with operations of the transfer intermediate belt 10. The image carrier operation history information is, for example, the total number of rotations, the rotation time, and the traveling distance, etc., of the transfer intermediate belt 10. The image carrier operation history information may be the total number of rotations, the rotation time, and the driving distance, etc., of the photosensitive drum 20, the drive roll 3, or the support rolls 4A to 4C, etc., or may be the number of output sheets P, etc.

In addition to the surface change information acquiring unit 11, the controller 11 includes the same environmental fluctuation calculating unit 11, normalization processing unit 112, density deviation calculating unit 113, and image forming condition correcting unit 114 as those of the first exemplary embodiment. The controller 11 updates the image carrier operation history information 122 according to the operations of the transfer intermediate belt 10.

The surface change information acquiring unit 110B acquires surface change information according to the image carrier operation history information 122. Hereinafter, significance of acquisition of the surface change information by the surface change information acquiring unit 110B will be described with reference to FIG. 9, and a surface change information acquiring method will be described with reference to FIG. 10.

Figure 9:
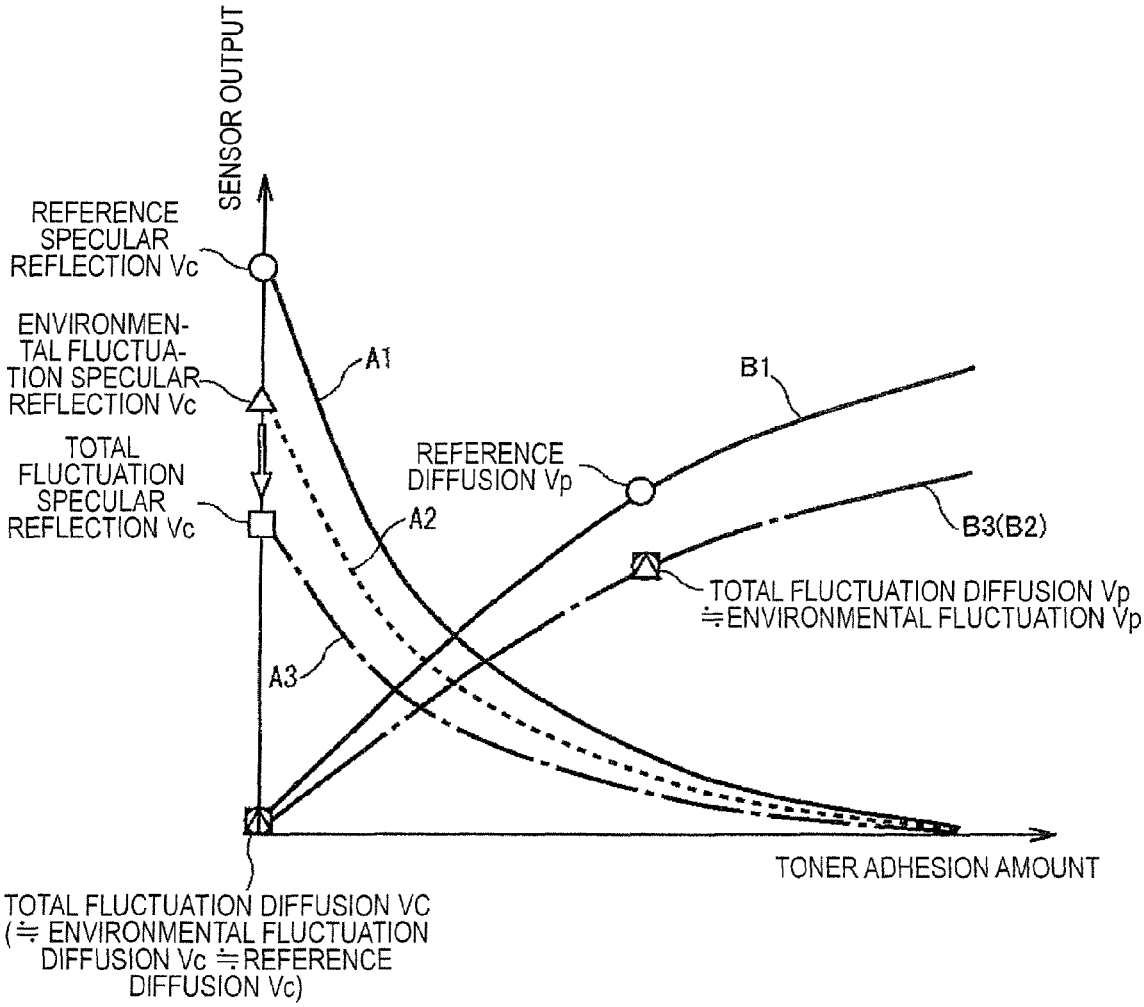
FIG. 9 is a diagram showing the relationship between toner density (horizontal axis) of the toner pattern and output values (vertical axis) of the density detector.

FIG. 9 is a diagram showing the relationship between the toner density (horizontal axis) of the toner pattern and output values (vertical axis) of the density detector. The graphs A1 to A3 and B1 to B3 shown in FIG. 9 correspond to the graphs attached with the same reference numerals in FIG. 5. The point of difference in FIG. 9 from FIG. 5 is that, even when the reflectance of the transfer intermediate belt 10 changes, the values of the diffusion reflection Vc and the diffusion reflection Vp do not change, so that the graph B3 overlaps the graph B2. In this case, the surface change information acquiring unit 110B cannot acquire surface change information from the amount of change of diffuse reflected light, so that surface change information is acquired according to image carrier operation history information instead.

Figure 10A:
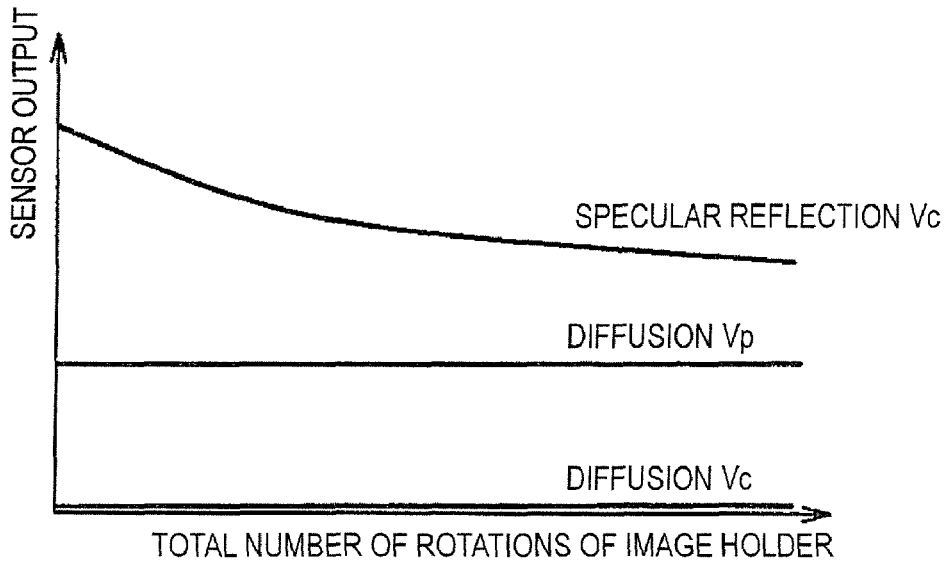
FIG. 10A is a diagram showing the relationship between the total number of rotations and output values of specular reflection Vc, diffuse reflection Vc, and diffuse reflection Vp.

FIG. 10A is a diagram showing the relationship between the total number of rotations (horizontal axis) as the image carrier operation history information and output values (vertical axis) of specular reflection Vc, diffuse reflection Vc, and diffuse reflection Vp. As the total number of rotations of the transfer intermediate belt 10 increases, as illustrated in FIG. 10, the specular reflection Vc from the surface of the transfer intermediate belt 10 as an object to be detected gradually lowers, however, the diffuse reflection Vc is substantially constant. Diffuse reflection Vp from the toner pattern 100 as an object to be detected is substantially constant similar to the diffuse reflection Vc if the toner adhesion amount is constant.

Figure 10B:
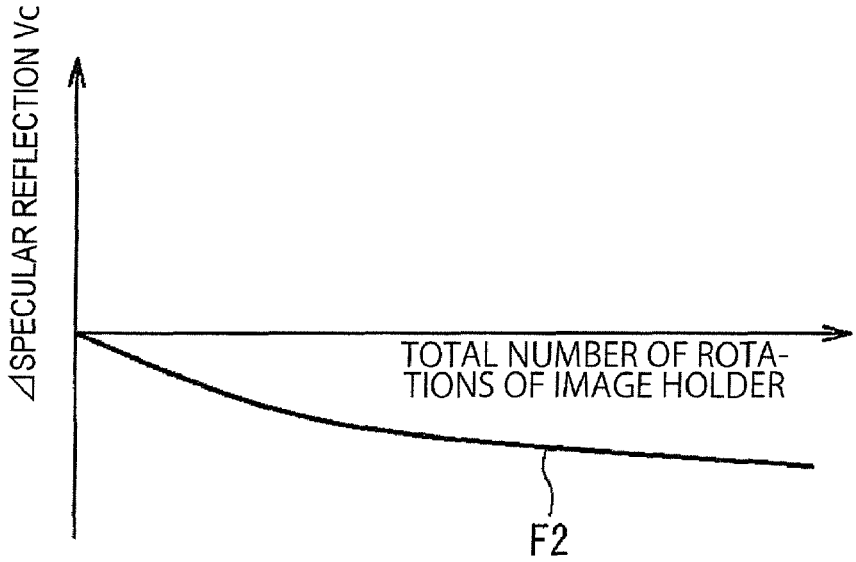
FIG. 10B is a diagram showing the relationship between the total number of rotations and an amount of change of diffuse reflected light "Δdiffusion Vc.

FIG. 10B is a diagram showing the relationship between the total number of rotations (horizontal axis) and the amount of change "Δdiffusion Vc" of diffuse reflected light (vertical axis). The relationship between the total number of rotations and Δdiffusion Vc is expressed as the function F2.

Therefore, by using the above-described relationship, the surface change information acquiring unit 404 calculates Δspecular reflection Vc according to the following formula (10) using the image carrier operation history information H to acquire surface change information.

$$\Delta\text{specular reflection } Vc = F2(H) \qquad \text{Formula (10)}$$

In the above-described configuration, the surface change information acquiring unit 110 of the image forming apparatus 1 of the present exemplary embodiment acquires Δspecular reflection Vc as surface change information according to the above-described formula (10). Next, the environmental fluctuation calculating unit 111 calculates environmental fluctuation specular reflection Vc according to the above-described formula (3) of the first exemplary embodiment by using Δspecular reflection Vc acquired by the surface change information acquiring unit 110B.

Subsequent processing is the same as in the first exemplary embodiment, and the normalization processing unit 112 performs normalization processing according to the above-described formula (4) and calculates density characteristic value RADC_diffusion Vp. Then, the density deviation calculating unit 113 calculates a density deviation ΔRADC according to the above-described formula (5) from RADC_diffusion Vp calculated according to the above-described formula (4) and the reference RADC based on the reference table 120.

Then, the image forming condition correcting unit 114 calculates correction amounts of image forming conditions based on the density deviation ΔRADC. When the correction amounts are transmitted from the controller 11 to the image forming units 2K, 2Y, 2M, and 2C, the image forming units 2K, 2Y, 2M, and 2C correct the image forming conditions based on the correction amounts.

Third Exemplary Embodiment

An image forming apparatus 1 of the third exemplary embodiment acquires surface change information according to cleaning history information concerning cleaning applied to the transfer intermediate belt 10 by the cleaning part 6 and corrects the image forming conditions.

Friction between the transfer intermediate belt 10 and the cleaning part 6 changes the reflectance of the transfer intermediate belt 10, so that the cleaning history information is used as information for estimating this change in reflectance.

The memory 12 stores cleaning history information. The cleaning history information is, for example, the number of times, the time, and the distance, etc., of cleaning. When the cleaning part 6 has a movement mechanism which comes into contact with the transfer intermediate belt 10 only when cleaning and moves and withdraws therefrom when it is not necessary, the cleaning history information may be the total number of rotations, the rotation time, and the traveling distance of the transfer intermediate belt 10 during contact with the transfer intermediate belt 10.

When cleaning is applied by the cleaning part 6, the controller 11 updates the cleaning history information. The surface change information acquiring unit of the controller 11 acquires surface change information according to the cleaning history information. Other points in the configuration are the same as in the second exemplary embodiment, so that description thereof is omitted.

Fourth Exemplary Embodiment

An image forming apparatus 1 of the fourth exemplary embodiment acquires surface change information according to colorant use history information concerning toner amounts used when forming toner images on the transfer intermediate belt 10, and corrects the image forming conditions.

Depending on the toner amounts used when forming toner images on the transfer intermediate belt 10, friction between the transfer intermediate belt 10 and the transfer devices 24 changes. The friction is also changed by the remaining toner amounts remaining after secondary transfer. Such friction changes influence the reflectance change of the transfer intermediate belt 10, so that the colorant use history information is used for estimating reflectance changes of the transfer intermediate belt 10 from the used toner amounts.

The memory 12 stores colorant use history information. The colorant use history information is, for example, an image density integrated value and a toner consumption integrated value, etc. As the colorant use history information, by storing toner amounts near the detecting position of the density detector 5 on the surface of the transfer intermediate belt 10, reflectance changes can be estimated more accurately than in the case of detection at another position.

When toner images are formed on the transfer intermediate belt 10 by the image forming units 2K, 2Y, 2M, and 2C, the controller 11 updates the colorant use history information according to the used toner amounts. The surface change information acquiring unit of the controller 11 acquires surface change information according to the colorant use history information. Other points in the configuration are the same as in the second exemplary embodiment, so that description thereof is omitted.

Fifth Exemplary Embodiment

An image forming apparatus 1 of the fifth exemplary embodiment includes a sensitivity change information acquiring unit which acquires sensitivity change information showing changes with time in detection sensitivity when detecting reflected light by the density detector 5, and according to the sensitivity change information acquired by the sensitivity change information acquiring unit, corrects output values of the density detector 5. Other points of the basic configuration are the same as those of the image forming apparatus 1 of the first exemplary embodiment. In the present exemplary embodiment, detector contamination information is used as the sensitivity change information.

Figure 11:
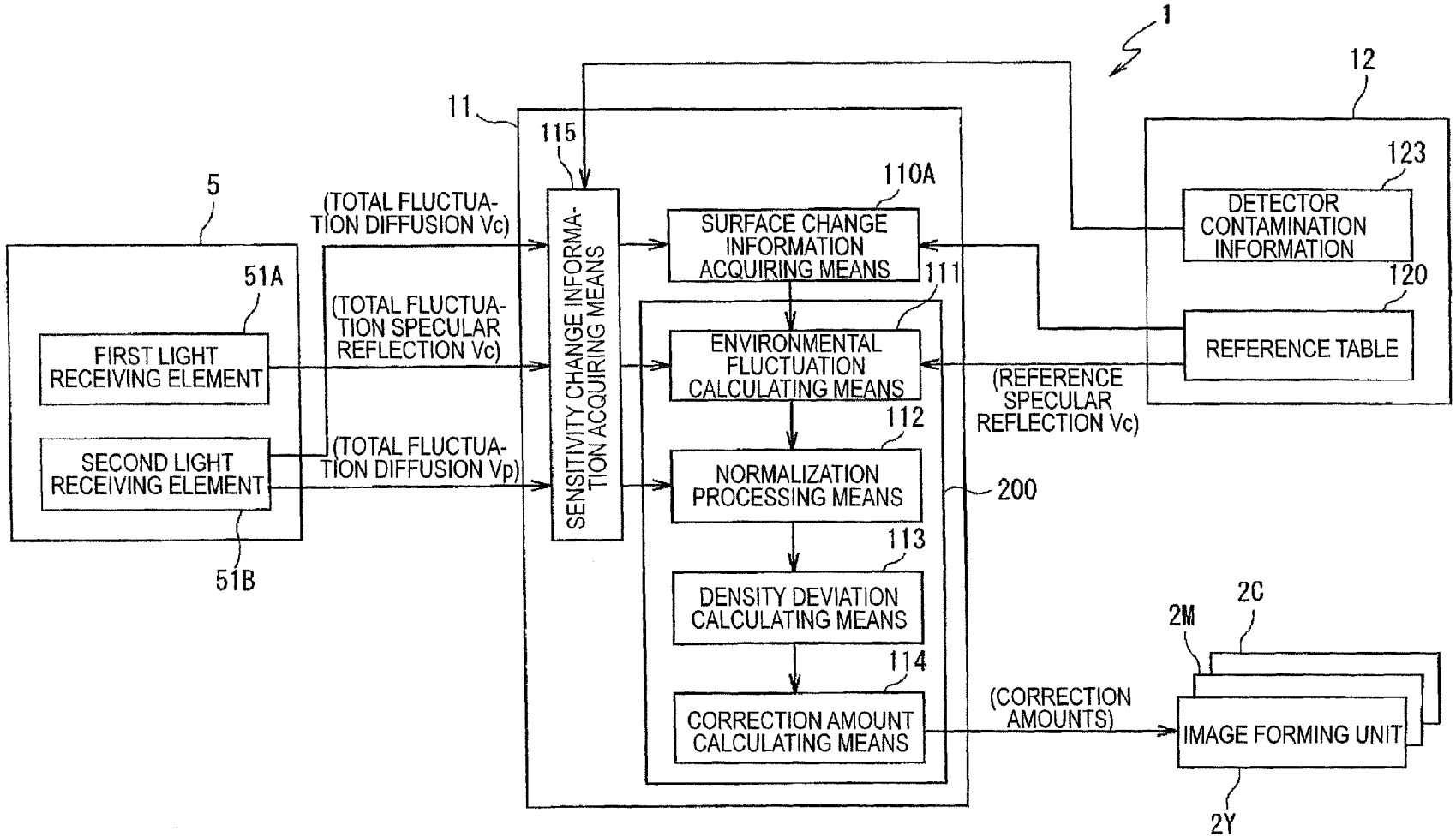
" and FIG. 11 is a block diagram showing an example of a control system of the image forming apparatus of the fifth exemplary embodiment of the present invention.

FIG. 11 is a block diagram showing an example of a control system of the image forming apparatus of the fifth exemplary embodiment. The memory 12 stores detector contamination information 123. When contamination components such as toner cloud floating inside the image forming apparatus 1 adhere to the density detector 5, output values of the density detector 5 change, so that the detector contamination information 123 is used as information for estimating changes in output sensitivity of the density detector 5 according to the degree of contamination adhering to the density detector 5. The detector contamination information 123 is, for example, the number of output sheets P, an image density integrated value, and operation times or numbers of operating rotations of the image forming units 2K, 2Y, 2M, and 2C, etc.

In addition to the sensitivity change information acquiring unit 115, the controller 11 includes the same surface change information acquiring unit 111A, environmental fluctuation calculating unit 111, normalization processing unit 112, density deviation calculating unit 113, and image forming condition correcting unit 114 as those of the first exemplary embodiment. The controller 11 updates the detector contamination information 123 according to the number of times of image formation and the used toner amounts.

The sensitivity change information acquiring unit 115 acquires sensitivity change information according to the detector contamination information 123, and corrects the total fluctuation specular reflection Vc, the total fluctuation diffusion Vc, and the total fluctuation diffusion Vp as output values of the density detector 5. For example, as the contamination on the density detector 5 becomes greater in the detector contamination information 123, the sensitivity change information acquiring unit 115 corrects output values of the density detector 5 so as to increase these. The sensitivity change information acquired by the sensitivity change information acquiring unit 115 can be used not only for correction of output values but also for correction of the reference RADC as an image density control target value.

Sixth Exemplary Embodiment

In an image forming apparatus 1 of the sixth exemplary embodiment, the density detector 5 includes a shutter mechanism as an opening and closing operation mechanism which prevents entrance of contamination components between the transfer intermediate belt 10 and the light receiving surface of the light receiving element, and according to opening and closing operation history information concerning opening and closing operations of the shutter mechanism, the sensitivity change information is acquired and image forming conditions are corrected.

When the shutter mechanism is open, while reflected light can be received by the light receiving element, contamination components enter the inside of the housing and change the light receiving amount from an object to be detected, so that the opening and closing operation history information is used as information for estimating changes in output sensitivity of the density detector 5 according to the opening and closing operations of the shutter mechanism.

The memory 12 stores opening and closing operation history information. The opening and closing operation history information may be, for example, the time or the number of times of opening of the shutter, the ratio of the time during which the shutter opens to the time during which the image forming apparatus 1 operates, or the like.

The controller 11 instructs the shutter mechanism to open and close, and according to the instruction, the controller updates the opening and closing operation history information. The sensitivity change information acquiring unit of the controller 11 acquires sensitivity change information according to the opening and closing operation history information and corrects output values of the density detector 5. Other points in the configuration are the same as those of the fifth exemplary embodiment, so that description thereof is omitted.

Seventh Exemplary Embodiment

In the image forming apparatus 1 of the seventh exemplary embodiment, the density detector 5 includes a cleaning mechanism which cleans the light emitting surface of the light emitting element or the light receiving surface of the light receiving element, and sensitivity change information is acquired according to cleaning history information concerning cleaning applied to the density detector 5 by the cleaning mechanism, and image forming conditions are corrected.

When cleaning is performed by the cleaning mechanism, friction between the light emitting surface or light receiving surface and the cleaning mechanism damages the surface, etc., of the light emitting surface or light receiving surface and changes the transmittance of the light emitting surface or light receiving surface, and accordingly, the light receiving amount from an object to be detected changes. The cleaning history information concerns such cleaning operations, and is used as information for estimating changes in output sensitivity of the density detector 5.

The memory 12 stores cleaning history information. The cleaning history information is, for example, the number of times and the time, etc., of cleaning by the cleaning mechanism. In the case where the cleaning history information is used in combination with the toner contamination information in the fifth exemplary embodiment, the toner contamination information is reset when cleaning is performed by the cleaning mechanism.

The controller 11 instructs the cleaning mechanism to perform a cleaning operation, and updates the cleaning history information according to this instruction. The sensitivity change information acquiring unit of the controller 11 acquires sensitivity change information according to the cleaning history information, and corrects output values of the density detector 5. Other points in the configuration are the same as those of the fifth exemplary embodiment, so that description thereof is omitted.

Other Exemplary Embodiments

The present invention is not limited to the above-described exemplary embodiments, and can be variously modified without departing from the gist of the present invention. For example, in the above-described exemplary embodiments, unit of the surface change information acquiring unit, the environmental fluctuation calculating unit, the normalization processing unit, the density deviation calculating unit, the correction amount calculating unit, and the sensitivity change information acquiring unit, etc., of the image forming apparatus may be realized by programs for operating the controller, or a part or all of these are realized by hardware.

The above-described programs may be read into the memory inside the image forming apparatus from a recording medium such as a CD-ROM, or may be downloaded into the memory inside the image forming apparatus from a server, etc., connected to a network such as the Internet.

The image forming apparatuses of the above-described exemplary embodiments are described as a tandem type, however, the present invention can also be applicable to a rotary type image forming apparatus. In addition, the present invention is applicable to an image forming apparatus using a photosensitive belt instead of the photosensitive drum.

The image forming apparatuses of the above-described exemplary embodiments are of an electrophotographic system, however, the present invention can be applied to various systems such as an inkjet system and a thermosensitive transfer system.

In the above-described exemplary embodiments, the colors of toners to be used by the image forming apparatuses are not limited to the three primary colors Y, M, and C, and the present invention can also be applied to a case where special colors (such as the color of a vermillion ink-pad) are used for patches in a plus-one color or multi-color image forming apparatus.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. An image density control device comprising:

a first detecting unit that detects a light amount of first specular reflected light which is reflected from a surface of an image carrier when light is irradiated onto a portion of no image on the surface of the image carrier;

a second detecting unit that detects a light amount of first diffuse reflected light which is reflected from an image on the surface of the image carrier when light is irradiated onto the image on the surface of the image carrier, wherein the image is formed by an image forming unit;

a surface change information acquiring unit that acquires a surface change information which shows changes with time in reflectance of the surface of the image carrier; and a control unit that corrects the light amount of the first specular reflected light by using the surface change information to a light amount of second specular reflected light, and controls the density of the image formed on the image carrier by using the light amount of the first diffuse reflected light and the light amount of the second specular reflected light.

2. The image density control device according to claim 1, wherein the second detecting unit detects a light amount of second diffuse reflected light which is reflected from the surface of the image carrier image when light is irradiated onto the portion of no image on the surface of the image carrier, and the surface change information acquiring unit acquires the surface change information according to the light amount of the second diffuse reflected light.

3. The image density control device according to claim 1, wherein the surface change information acquiring unit acquires the surface change information according to a history information of an operation of the image carrier that concerns the operation of the image carrier when the image is formed on the image carrier by the image forming unit.

4. The image density control device according to claim 1, wherein the surface change information acquiring unit acquires the surface change information according to a cleaning history information that concerns a cleaning to clean the image carrier.

5. The image density control device according to claim 1, wherein the surface change information acquiring unit acquires the surface change information according to a history information of a colorant use that concerns the colorant use when the image is formed on the image carrier by the image forming unit.

6. The image density control device according to claim 1, further comprising:

a sensitivity change information acquiring unit that acquires a sensitivity change information that shows changes with time in a detection sensitivity when the light amount of the first specular reflected light and the light amount of the first diffuse reflected light are detected by the first and second detecting units, wherein the control unit corrects, according to the sensitivity change information, the light amount of the first specular reflected light, the light amount of the first diffuse reflected light, or a density target value of the image.

7. The image density control device according to claim 6, wherein the sensitivity change information acquiring unit acquires the sensitivity change information according to a contamination information that concerns a contamination on the first and second detecting units.

8. The image density control device according to claim 6, wherein the first and second detecting units include an opening and closing operation mechanism arranged between the image carrier and a detecting surface which the first and second detecting units detects reflected light and the sensitivity change information acquiring unit acquires the sensitivity change information according to an history information of an opening and closing operation that concerns the opening and closing operation by the opening and closing operation mechanism.

9. The image density control device according to claim 6, wherein the first and second detecting units include a cleaning mechanism that cleans a detecting surface which the first and second detecting units detects reflected light, and the sensitivity change information acquiring unit acquires the sensitivity change information according to a history information of the cleaning mechanism that concerns the cleaning mechanism.

10. An image forming apparatus comprising:

an image carrier that carries an image;

an image forming unit that forms the image on the image carrier;

a first detecting unit that detects a light amount of first specular reflected light which is reflected from a surface of an image carrier when light is irradiated onto a portion of no image on the surface of the image carrier;

a second detecting unit that detects a light amount of first diffuse reflected light which is reflected from an image on the surface of the image carrier when light is irradiated onto the image on the surface of the image carrier, wherein the image is formed by an image forming unit;

a surface change information acquiring unit that acquires a surface change information which shows changes with time in reflectance of the surface of the image carrier; and a control unit that corrects the light amount of the first specular reflected light by using the surface change information to a light amount of second specular reflected light, and controls the density of the image formed on the image carrier by using the light amount of the first diffuse reflected light and the light amount of the second specular reflected light.

* * * * *